US008603958B2

(12) United States Patent
Litters et al.

(10) Patent No.: US 8,603,958 B2
(45) Date of Patent: Dec. 10, 2013

(54) CALCIUM/LITHIUM COMPLEX GREASES AND ENCAPSULATED CONSTANT VELOCITY JOINT CONTAINING THE GREASE AND METHOD FOR THEIR PRODUCTION

(75) Inventors: Thomas Litters, Hettenleidelheim (DE); Alexander Liebenau, Osthofen (DE)

(73) Assignee: Fuchs Petrolub AG, Manheim (DE)

( * ) Notice: Subject to any disclaimer, the term of this patent is extended or adjusted under 35 U.S.C. 154(b) by 531 days.

(21) Appl. No.: 12/509,262

(22) Filed: Jul. 24, 2009

(65) Prior Publication Data

US 2010/0048436 A1 Feb. 25, 2010

(30) Foreign Application Priority Data

Jul. 25, 2008 (DE) ..... 10 2008 034 959

(51) Int. Cl.
*C10M 171/00* (2006.01)
*C10M 169/02* (2006.01)

(52) U.S. Cl.
USPC ..... 508/523; 508/154; 508/174

(58) Field of Classification Search
USPC ..... 508/174, 154, 523
See application file for complete search history.

(56) References Cited

U.S. PATENT DOCUMENTS

| | | | | |
|---|---|---|---|---|
| 2,929,782 | A * | 3/1960 | Sproule et al. | 508/523 |
| 3,844,955 | A | 10/1974 | Green | |
| 4,986,923 | A | 1/1991 | Waynick | |
| 5,006,376 | A | 4/1991 | Arima et al. | |
| 5,295,914 | A * | 3/1994 | Milavec | 464/175 |

FOREIGN PATENT DOCUMENTS

| | | | |
|---|---|---|---|
| CN | 1276412 | A | 12/2000 |
| DE | 3508718 | A1 | 9/1985 |
| DE | 3417708 | A1 | 11/1985 |
| WO | 8505421 | A1 | 12/1985 |
| WO | 9411470 | A1 | 5/1994 |
| WO | 2008040381 | A1 | 4/2008 |

OTHER PUBLICATIONS

European Search Report dated Aug. 9, 2011 for European Counterpart Application No. EP09009621.5.

* cited by examiner

*Primary Examiner* — Pamela H Weiss
(74) *Attorney, Agent, or Firm* — D'Ambrosio & Menon, PLLC; Usha Menon

(57) ABSTRACT

Embodiments of the invention include compositions of calcium/lithium complex greases containing calcium/lithium soaps having a high calcium fraction and complexing agents, encapsulated constant velocity shafts containing such lubricating greases and the use of the lubricating greases in encapsulated shafts of constant velocity shafts.

12 Claims, 4 Drawing Sheets

CALCIUM/LITHIUM COMPLEX GREASES AND ENCAPSULATED CONSTANT VELOCITY JOINT CONTAINING THE GREASE AND METHOD FOR THEIR PRODUCTION

PRIORITY

This application is based on and claims the benefit of priority from German patent application No. 10 2008 034 959.3, filed Jul. 25, 2008.

BACKGROUND OF THE INVENTION

For tribosystems, in particular those such as are used in many technical applications, it is important to use lubricants to reduce the friction and the wear on the contact surfaces of moving parts. In this context, lubricants of different consistency can be used depending on the area of application. Lubricating oils have a liquid and flowable consistency whereas lubricating greases have a semi-solid to solid, frequently gel-like, consistency.

A characteristic feature of a lubricating grease it that a liquid oil component is taken up and retained by a thickener component. The pasty nature of a lubricating grease and its property of being spreadable and plastically easily deformable together with the property of being adhesive ensures that the lubricating grease wets the lubricating point and the lubricating effect develops at the tribologically stressed surfaces.

Lubricating greases generally consist of a thickener which is homogeneously distributed in a base oil. Additional adjuvants such as emulsifiers are frequently used so that the thickener is stably dispersed in the base oil. Various substances are known as base oils. Organic and inorganic compounds are used as thickeners.

The most important rheological properties of a lubricating grease include the consistency or its flow limit, the avoidance of post-curing and excessive oil deposition under thermal and mechanical loading as well as a stable viscosity-temperature behaviour. Frequently at lubricating points sealed against egress of lubricating grease, a thixotropic (shear thinning) and shear-unstable behaviour of the lubricating grease is also advantageous as long as a consistent lubricating grease is only required for the mounting of corresponding components. A high degree of practical experience is required to create a lubricating grease of high usage value depending on the lubricating and equipment requirements.

Lubricating greases are frequently used in encapsulated or sealed environments in order to protect the lubricating point from water, minimise losses of lubricating grease and avoid the ingress of particles such as sand or dust. A typical application is greased joints of constant velocity shafts encapsulated with plastic bellows. In this case, the encapsulating material frequently entrains the movements of the parts which are moving with respect to one another or at least takes up vibrations. For this purpose a mobility and in most cases, also elasticity of the material is required which must not be negatively influenced by the contact or by the interaction with the lubricating grease. It has been observed, however, that conventional lubricating greases attack these encapsulating materials, with the result that these become brittle, for example, and/or are damaged by hydrolytic degradation.

Product solutions and property rights existing for the grease lubrication of constant velocity shafts are predominantly concerned with tribological questions and to a lesser degree with the provision of tribocontacts by thixotropic and/or shear-unstable greases as well as the compatibility of lubricating grease and bellows material. Among other things, the continued miniaturisation of constant velocity shafts in vehicles has led to a demand for an improved lubricant in order to satisfy the higher requirements regarding friction and tribology. The new types of lubricant according to the invention have therefore been developed because they act very well at higher ambient temperatures which are associated with the continuing vehicle development.

For the use of lubricating greases in constant velocity shafts, these must not have too-high flow limits which prevent the lubricating grease from automatically flowing back into the lubricating gap after it has been previously hurled out of the lubricating gap, for example, due to centrifugal forces.

Numerous formulation patents exist which have as their subject matter the combination of lithium, calcium, lithium complex and polyurea thickeners as consistency-giving components.

It is considered to be a shortcoming of this prior art that most lithium or lithium grease complexes and also most lithium/calcium greases have a too-high shear stability with the consequence of increased flexing work and elevated steady-state temperatures in the joint caused by this.

As a result of the greater thermal stressing of the grease and the bellows materials, this brings about a shortened lifetime of the entire system. An inadequate flow of grease causes a deficient supply and therefore inferior wetting of the tribologically stressed surfaces. As a consequence, this leads to increased wear associated with a reduction of the lifetime and a reduced efficiency caused by increased friction.

Commonly used soap thickeners, in particular the lithium and lithium complex greases widely used in joint shafts, as well as polyurea greases have a too-low alkaline buffer effect in order to prevent the formation of free acids from the grease matrix, primarily from the additives, and therefore the acidic hydrolysis of ester-group-containing polymer chains during the ageing of the grease/thermoplastic elastomer (TPE). Furthermore, the excess lithium hydroxide present in the lithium greases in turn ensures alkaline hydrolysis of the ester groups which likewise leads to a loss of the mechanical stability of the bellows. Commonly used urea greases have no alkali reserve or only a very low alkali reserve. Acidic ageing products formed in these greases can only be inadequately neutralised.

SUMMARY OF THE INVENTION

The object of the present invention is, inter alia, to minimise the disadvantages described above in regard to the bellows compatibility and the loss of efficiency and lifetime in joint shafts. The object is achieved by the subject matter of the independent claims. Preferred embodiments are the subject matter of the dependent claims or described hereinafter.

It has been found that unlike conventional lithium or calcium greases, the calcium/lithium complex soaps according to the invention (Ca/Li complex soaps) having a high fraction of calcium exhibit unexpectedly good properties when used as lubricating grease for constant velocity joints. Such products differ significantly from conventional Li/Ca greases.

DETAILED DESCRIPTION

Figure 1:
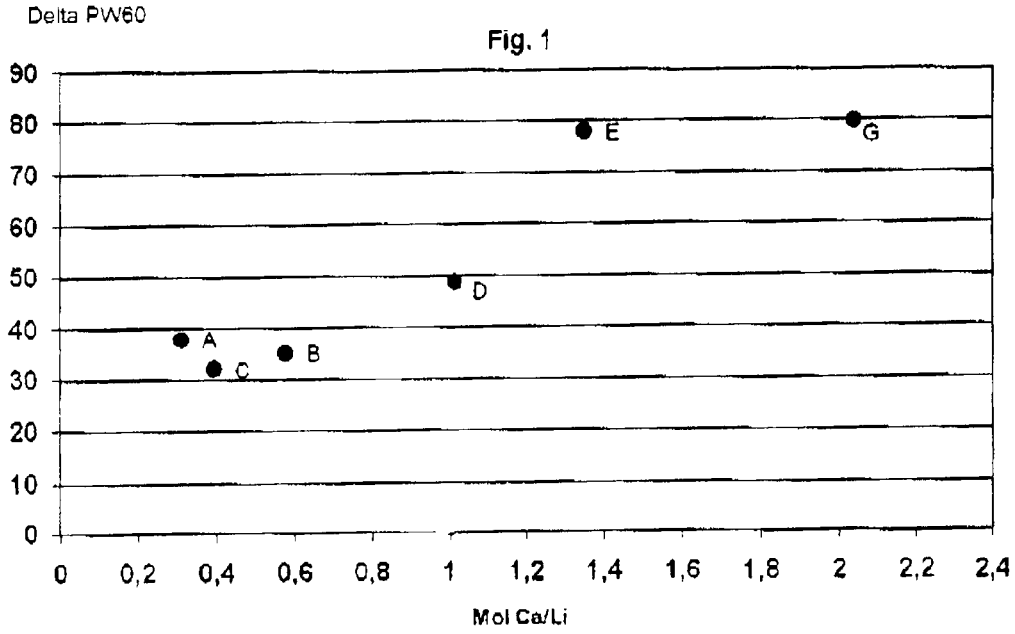
FIG. 1 shows the worked resistance of the exemplary greases according to DIN ISO 2137.

The Ca/Li soaps or Ca/Li complex soaps can preferably be produced in situ using the corresponding carboxylic acid compounds and not by mixing separately produced Ca and Li soaps or Ca and Li complex soaps. According to the embodiment according to the invention, the calcium hydroxide present in excess in combination with the Ca/Li complex grease buffers the acidic ageing products without any significant alkaline hydrolysis of the ester groups of the thermoplastic elastomer occurring as a result of the comparatively low basicity and dissociation of calcium hydroxide.

It has been found that the Ca/Li complex greases are preferably produced so that the amount of lithium compound and calcium compound required for the conversion are determined so as to ensure that the more reactive lithium compound (preferably LiOH in the present case) reacts as completely as possible with the carboxyl groups of the carboxylic acids used and the remaining carboxyl groups not reacted with the lithium compound are reacted, as it were, in excess with calcium compounds, preferably $Ca(OH)_2$ in the present case.

In addition, the calcium soaps present in excess should lead to a reduced mechanical stability or lower flow limit after running in the joint shafts and thus lead to an improved supply of friction points in the constant velocity joints.

The product formulation contains an additional complexing agent in order to compensate for the drop in dropping point observed due to the increased calcium fraction, e.g. to below 180° C. The composition according to the invention is therefore designated as Ca/Li complex grease or Ca/Li complex soap grease and not as Ca/Li grease or Ca/Li soap grease.

The use of excess calcium hydroxide and calcium soaps counteracts the acidic ageing products such as are formed due to the use of additives. The ageing products contribute to the destruction of the bellows.

The composition according to the invention is composed of:

a) a base oil (comprising a base oil mixture), preferably of 55 to 92 wt. % and in particular 70 to 85 wt. %,
b) additives, preferably of 0.5 to 40 wt. % and in particular 2 to 10 wt. %,
c) thickener, wherein the thickener is a complex soap comprising a calcium/lithium soap and a complexing agent and the complex soap is preferably contained as 5 to 25 wt. % and in particular as 10 to 20 wt. % and
d) excess $Ca(OH)_2$, preferably 0.01 to 2 wt. %.

The wt. % data relate to the overall composition and apply in each case independently of one another. A component assigned to one of the groups a), b), c) or d) cannot simultaneously be a component of another group a) to d).

The composition is further characterized by a calcium/lithium molar ratio of 1.0 to 5.0 to 1, preferably 1.2 to 3.0 to 1 and in particular 1.4 to 2.4 to 1, wherein the ratio is determined by all the calcium and lithium compounds present, i.e. the $Ca(OH)_2$ present is also included, for example.

In particular, the thickener is used such that the composition contains so much thickener that a cone penetration value (worked penetration) of 265 to 385 mm/10 (at 25° C.), preferably 285 to 355 mm/10, is obtained (determined in accordance with DIN ISO 2137 or ASTM D 0217-97).

The usual lubricating oils which are liquid at room temperature are used as base oil. The base oil preferably has a kinematic viscosity of 20 to 2500 $mm^2/s$, in particular of 40 to 500 $mm^2/s$ at 40° C.

The base oils can be classified as mineral oils or synthetic oils. Considered as mineral oils, for example, are naphthene-based mineral oils and paraffin-based mineral oils, as classified according to API Group I. Chemically modified low-aromatic and low-sulphur mineral oils having a low fraction of saturated compounds and improved viscosity/temperature behaviour compared with group I oils, classified according to API Group II and III, are also suitable.

Named as synthetic oils are polyethers, esters, polyalphaolefins, polyglycols and alkyl aromatic compounds and mixtures thereof. The polyether compound can comprise free hydroxyl groups but can also be completely etherised or terminal group esterified and/or produced from a starting compound having one or more hydroxy and/or carboxyl groups (—COOH). Polyphenyl ethers, optionally alkylated, are also possible as sole components or better as mixed components. It is suitable to use esters of an aromatic di-, tri- or tetracarboxylic acid, with one or a mixture of C2 to C22 alcohols, esters of adipic acid, sebacic acid, trimethylolopropane, neopentylgycol, pentaerythrite or dipentaerythrite with aliphatic branched or unbranched, saturated or unsaturated C2 to C22 carboxylic acids, C18 dimeric acid esters with C2 to C22 alcohols, complex esters, as single components or in any mixture.

The Ca/Li soap is a mixture of calcium salts and lithium salts of one or more saturated or unsaturated monocarboxylic acids having 10 to 32 carbon atoms, optionally substituted, in particular having 12 to 22 carbon atoms, particularly preferably corresponding hydroxycarboxylic acids. Suitable carboxylic acids are, for example, lauric acid, myristic acid, palmitic acid, oleic acid, stearic acid or behenic acid as well as preferably 12-hydroxystearic acid. Instead of the free acidic groups, corresponding lower alcohol esters can also be used while saponifying, e.g. corresponding triglycerides as well as methyl, ethyl, propyl, isopropyl or sec.-butyl esters of the acid/hydroxy acid in order to achieve a better dispersion.

Due to the presence of a complexing agent, the Ca/Li soap becomes a Ca/Li complex soap. Complexing agents in the sense of the present invention are:

(a) the alkali (preferably lithium salt), alkaline earth (preferably calcium salt) or aluminium salt of a saturated or unsaturated monocarboxylic acid or also hydroxycarboxylic acids having 2 to 8, in particular 2 to 4 carbon atoms or a dicarboxylic acid having 2 to 16, in particular 2 to 12 carbon atoms, in each case, optionally substituted and/or
(b) the alkali and/or alkaline earth salt of boric acid and/or phosphoric acid, in particular conversion products with LiOH and/or $Ca(OH)_2$.

The complexing agent (a) is preferred. Particularly suitable as monocarboxylic acids are acetic acid and propionic acid. Likewise suitable are hydroxybenzoic acids such as parahydroxybenzoic acid, salicylic acid, 2-hydroxy-4 hexylbenzoic acid, metahydroxybenzoic acid, 2,5-dihydroxybenzoic acid, 2,5-dihydroxybenzoic acid (gentisinic acid), 2,6-dihydroxybenzoic acid (gamma-resorcylic acid) or 4-hydroxy-4-methoxybenzoic acid. Particularly suitable as dicarboxylic acids are adipic acid ($C_6H_{10}O_4$), sebacic acid ($C_{10}H_{18}O_4$), azelaic acid ($C_9H_{16}O_4$) and/or 3-tert.-butyl-adipic acid ($C_{10}H_{18}O_4$).

Metaborate, diborate, tetraborate or orthoborate, such as for example, monolithium orthoborate or calcium orthoborate can be used, for example, as borate (b). Possible phosphates are alkali (preferably lithium), as well as alkaline earth (preferably calcium), dihydrogen phosphate, hydrogen phosphate or pyrophoshate.

In addition, bentonites such as montmorillonite (whose sodium ions are optionally exchanged or partially exchanged by ammonium ions), aluminosilicates, alumina, silicic acid (e.g. Aerosil), copper phthalocyanines or also di- and polyureas can optionally be used as co-thickeners.

The compositions according to the invention further contain additives as adjuvants. Usual additives in the sense of the invention are antioxidants, antiwear agents, anticorrosives, detergents, dyes, lubricity improvers, viscosity additives, friction modifiers and high-pressure additives.

As examples, mention may be made of:

- antioxidants such as amine compounds (e.g. alkyl amines or 1-phenyl aminonaphthaline), aromatic amines such as, for example, phenylnaphthyl amines or diphenylamines, phenol compounds (e.g. 2,6-di-tert-butyl-4-methylphenol), sulphur antioxidants, zinc dithiocarbamate or zinc dithiophosphate;
- high-pressure additives such as organic chlorine compounds, sulphur, phosphorus or calcium borate, zinc dithiophosphate, organic bismuth compounds;
- "oiliness" improving substance such as C2 to C6 polyols, fatty acids, fatty acid esters or animal or vegetable oils;
- anticorrosives such as petroleum sulfonate, dinonylnaphthalone sulfonate or sorbitan ester;
- metal deactivators such as benzotriazole or sodium nitrite;
- viscosity improvers such as, for example, polymethacrylate, polyisobutylene, oligo-dec-1-ene, and polystyrenes;
- antiwear additives and friction modifiers such as organomolybdenum complexes (OMC), molybdenum-di-alkyl dithiophosphates, molybdenum-di-alkyl-dithiocarbamates or molybdenum sulfide-di-alkyl-dithiocarbamates, in particular molybdenum-di-n-butyl dithiocarbamate and molybdenum disulfid-di-alkyl dithiocarbamate ($MO_2O_mS_n$ dialkylcarbamate)$_2$ with m=0 to 3 and n=4 to 1), friction modifiers such as functional polymers such as, for example, oleylamides, polyether- and amide-based organic compounds, for example, alkylpolyethylene glycoltetradecylene glycol ether.

In addition, the lubricating grease compositions according to the invention contain usual additives against corrosion, oxidation, and for protection against metal influences which act as chelate compounds, radical collector, UV converters, reaction layer formers and the like.

For example, polymer powders such as polyamides, polyimides or PTFE, graphite, metal oxides, boron nitride, metal sulfides such as, for example, molybdenum disulfide, tungsten disulfide or mixed sulfides based on tungsten, molybdenum, bismuth, tin and zinc, inorganic salts of alkali and alkaline earth metals such as, for example, calcium carbonate, sodium and calcium phosphates, can be used as solid lubricants. Solid lubricants can be divided into the following four groups: compounds having a layer lattice structure such as molybdenum disulfide and tungsten disulfide, graphite, hexagonal boron nitride and some metal halides; oxide or hydroxide compounds of the transition and rare earth metals or their carbonates or phosphates; soft metal and/or plastics.

According to a further embodiment of the invention, the sealing material, including encapsulating materials which are in contact with the lubricant, is a polyester, preferably a thermoplastic copolyester elastomer comprising hard segments with crystalline properties and a melting point above 100° C. and soft segments having a glass transition temperature of less than 20° C., preferably less than 0° C.

Particularly suitable are polychloroprene rubber and thermoplastic polyester (TPE), thermoplastic polyether ester (TEEE=thermoplastic ether ester elastomer). The latter are available on the market under the trade names Arnitel® from DSM, Hytrele® from DuPont and PIBI-Flex® from P-Group.

The hard segments are derived, for example, from at least one aliphatic diol or polyol and at least one aromatic di- or polycarboxylic acid, the soft segments having elastic properties, for example, from ether polymers such as polyalkylene oxide glycols or non-aromatic dicarboxylic acids and aliphatic diols. These compounds are designated, for example as copolyether esters.

Copolyether ester compositions are used in components, for example when the component produced therefrom is exposed to frequent deformation or vibrations. Very well known applications in this respect are bellows or spring bellows for protecting drive shafts and transmission shafts, steering columns and suspension units as well as sealing rings. In such applications, the material comes frequently or continuously in contact with lubricants such as lubricating greases.

Technically, it is possible to proceed by producing the bellows by injection blow moulding, injection extrusion or extrusion blow moulding, wherein annular parts made of rubber are optionally inserted beforehand in the mould at the two future clamping points.

The resistance of the copolyether ester composition to the effects of oils and greases is one of the reasons for its widespread use along with its easy processability in relatively complex geometries.

A lubricating grease according to the present invention should preferably, but not exclusively, be used for lubricating constant velocity joints (homokinetic joints or "constant velocity joint" CVJ) such as are used, for example, in drive shafts for motor vehicles. The task of a constant velocity joint is the uniform transmission of torque from one shaft to a second shaft mounted at an angle thereto at articulation angles of up to 50°.

In vehicle construction constant velocity joints are used particular in front-wheel drive and all-wheel drive vehicles and are generally divided into two groups: constant velocity fixed joints and constant velocity slip joints. The group of constant velocity fixed joints includes ball joints ("ball joints" BJ) and undercut free constant velocity joints ("undercut free" UJ). The group of constant velocity slip joints is formed by tripod constant velocity joints ("tripod joints" TJ), double offset joints ("double offset joints" DOJ) and cross groove constant velocity joints ("cross groove joints" LJ). In contrast to constant velocity fixed joints, constant velocity slip joints not only ensure uniform torque transmission at different articulation angles but additionally provide length compensation of the drive shaft connecting the transmission to the wheel.

Since constant velocity joints are almost exclusively lubricated with lubricating greases, they are usually encapsulated with a bellows to prevent egress of lubricating grease or ingress of dirt or moisture. This bellows is usually designed in one piece and inverted over the drive shaft after greasing or mounting the constant velocity joint.

The property profile of the different greases as produced hereinafter is characterized in detail by the figures and Table 1.

DESCRIPTION OF THE FIGURES

In detail the figures show:

FIG. 1: change in the consistency after Pw 100,000 double strokes according to DIN ISO 2137 as a function of the Ca/Li ratio.

Figure 2:
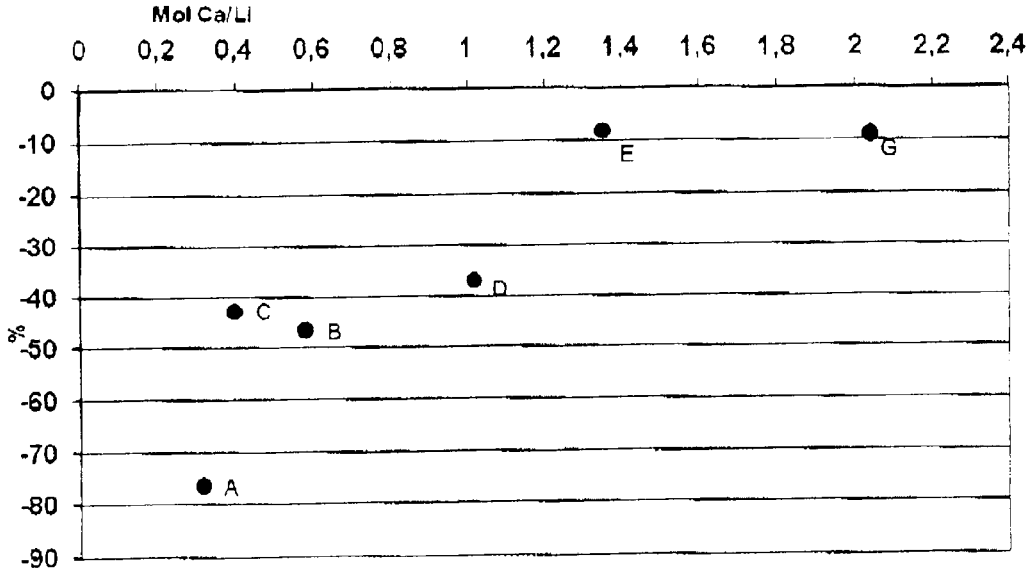
FIGS. 2 to 5 show the compatibility of the greases according to experimental examples with various TEEE bellows material, plotted versus the percentage change in the ultimate elongation after thermal ageing in the lubricating grease.

FIG. 2: change in the ultimate elongation for TPE ARNITEL EB 464 according to DIN 53455 after 336 hours embedding in lubricating grease at 125° C.

Figure 3:
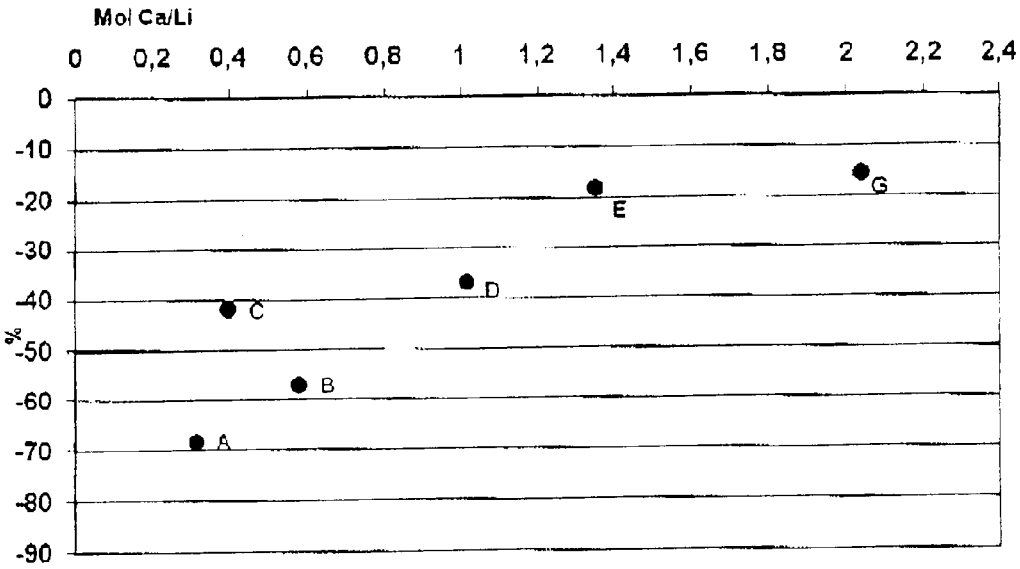

FIG. 3: change in the ultimate elongation for TPE HYTREL 8105 BK according to DIN 53455 after 336 hours embedding in lubricating grease at 125° C.

Figure 4:
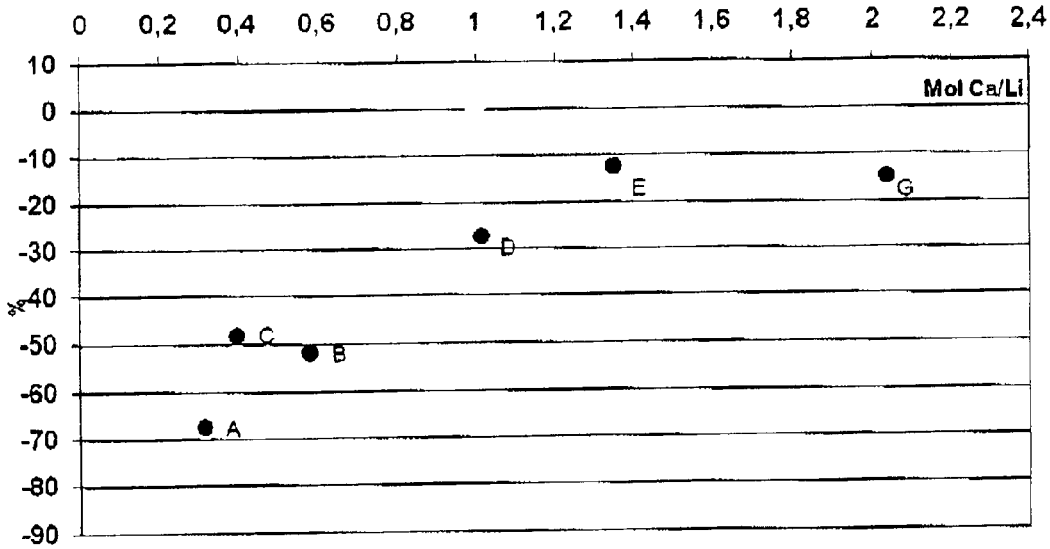

FIG. 4: change in the ultimate elongation for TPE HYTREL 8223 BK according to DIN 53455 after 336 hours embedding in lubricating grease at 125° C.

Figure 5:
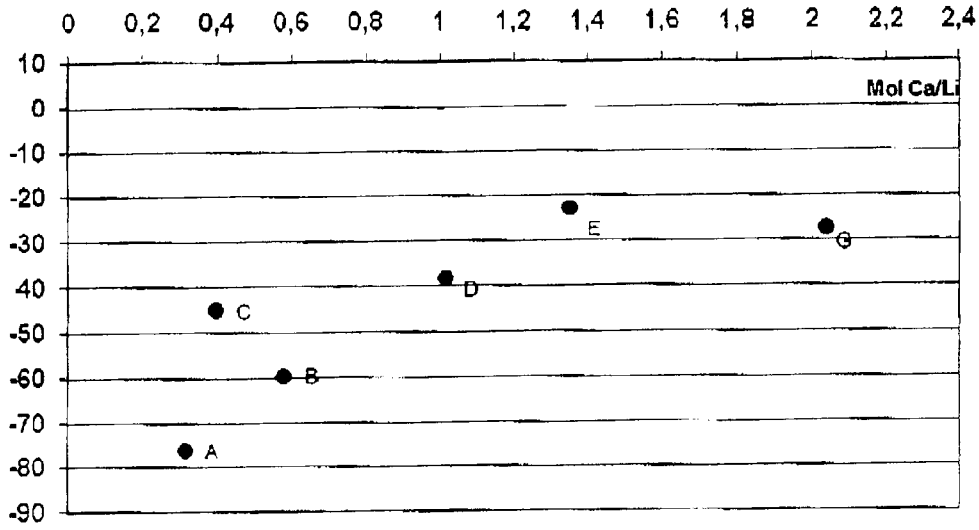

FIG. 5: change in the ultimate elongation for TPE PIBEFLEC 5050 according to DIN 53455 after 336 hours embedding in lubricating grease at 125° C.

Figure 6:
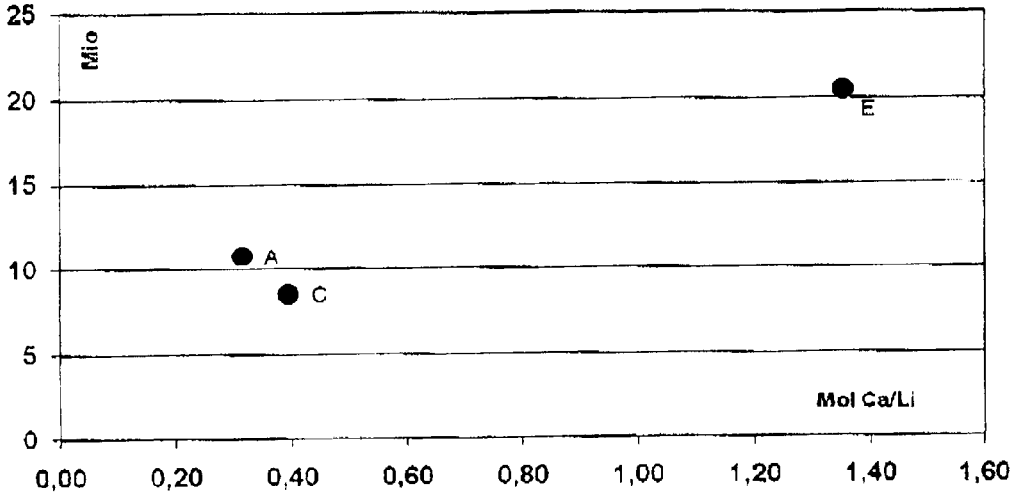
FIG. 6 shows the average lifetime of constant velocity fixed joints shown in the number of rollovers and FIG. 7 shows the efficiency of constant velocity fixed joints shown as the average steady-state temperature versus the total test duration.
Figure 7:
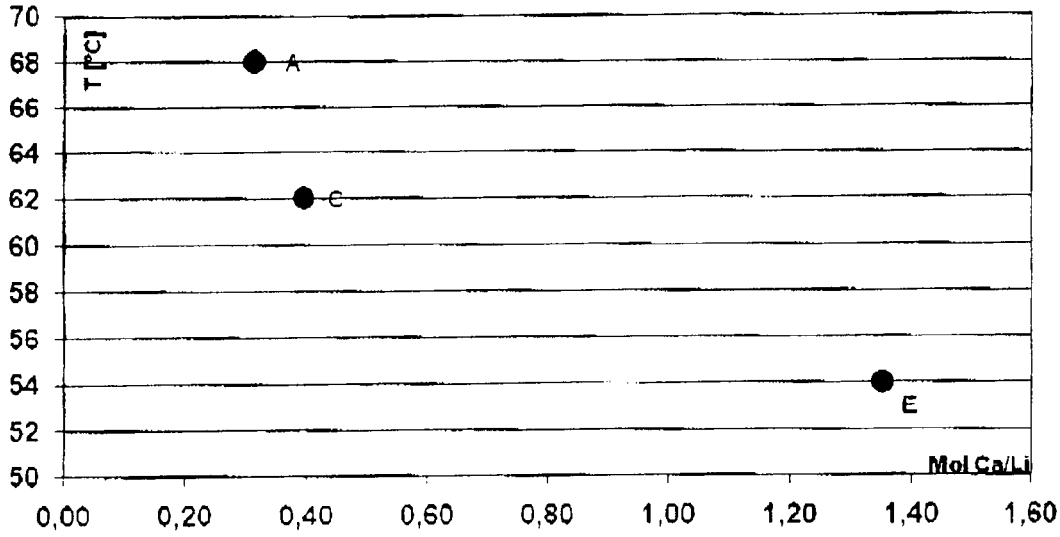

FIG. 6: lifetime on the joint shaft test rig "GIM Four Square Test Rig" in UF fixed joint, clamping moment 500 Nm, articulation angle 10°, speed 250 rpm FIG. 7: steady-state temperature on the joint shaft test rig "GIM Four Square Test Rig" in UF fixed joint, clamping moment 500 Nm, articulation angle 10°, speed 250 rpm.

EXAMPLES

The manufacture of the lubricating greases can take place, for example, as follows: Mixing the salt/metal compound into the carboxylic acid compound which can optionally be diluted with the base oil component and optional simultaneous heating of the mixture to a temperature above 70° C. to form a thickened lubricating grease product, cooling the lubricating grease product and optionally adding water, allowing shear forces to act on the mixture, for example, using a crosshead mill, a high-pressure homogeniser and/or a triple roller.

For this purpose, in a first step a vessel with an agitator at a rotational speed of 0 to 150 rpm was charged with 3 to 40 wt. % of the educt components of the thickener and 20 to 90 wt. % of the base oil, relative to the total weight of the finished lubricating grease composition.

According to a preferred embodiment of the invention, the thickener is synthesized in situ in the base oil, preferably under pressure and elevated temperature in a closed reaction vessel such as an autoclave.

Description of Production Example A to C (Comparative Example)

The production of the exemplary formulations A-C is based on known and usual methods for producing corresponding thickeners.

Description of Production Example E

In a reactor 1,540 g of 12-hydroxystearic acid (12-HSA) and 560 g of sebacic acid were placed in 12,000 g of a base oil mixture and heated until the 12-HSA melts whilst agitating. In the next step, 125 g of LiOH and 295 g of $Ca(OH)_2$ were added. The $Ca(OH)_2$ was dissolved in 300 g of water before adding to the reactor. The formulation was heated in a fixed temperature program to the intended maximum process temperature whilst agitating. In the cooling phase additives were added to the formulation at specified temperatures. After adjusting the formulation to the desired consistency by adding 5,400 g of base oil mixture, the end product was homogenized by means of a crosshead mill.

Description of production Example D and G: the exemplary formulations were produced by analogy with exemplary formulation E by varying the amounts of LiOH and $Ca(OH)_2$.

TABLE 1

| Formulation examples | | | | | | |
|---|---|---|---|---|---|---|
| | Example A Reference A | Example B Reference B | Example C Reference C | Example D Invention | Example E Invention | Example G Invention |
| Thickener Production | LiX + Ca 1/1 compound | LiX + CaX 1/1 compound | LiX/CaX in situ | CaX/LiX in situ | CaX/LiX in situ | CaX/LiX in situ |
| Amount of Ca [mol-%] | 0.010 | 0.019 | 0.011 | 0.016 | 0.020 | 0.024 |
| Amount of Li [mol-%] | 0.033 | 0.033 | 0.028 | 0.016 | 0.015 | 0.012 |
| Factor of amount of % Ca/Li | 0.31 | 0.58 | 0.39 | 1.01 | 1.35 | 2.04 |
| 1. Formulation | | | | | | |
| 1.1 fatty acid: | | | | | | |
| 12-HSA | 7.34 | 4.39 | 6.64 | 7.95 | 7.69 | 7.52 |
| Mixed fatty acid | | 2.78 | | | | |
| Beef tallow | | 2.68 | | | | |
| 1.2 Alkali: | | | | | | |
| LiOH*H2O | 1.39 | 1.39 | 1.18 | 0.67 | 0.62 | 0.50 |
| Ca(OH)2 | 0.77 | 1.42 | 0.82 | 1.20 | 1.48 | 1.80 |
| 1.3 Complexing agent: | | | | | | |
| Azelaic acid | 1.59 | 1.59 | | | | |
| Sebacic acid | | | 2.32 | 2.78 | 2.83 | 2.85 |
| Acetic acid | | 2.42 | | | | |
| Trisodium phosphate | | 0.13 | | | | |
| Disodium tetraborate | | 0.13 | | | | |

TABLE 1-continued

| Formulation examples | | | | | | |
|---|---|---|---|---|---|---|
| | Example A Reference A | Example B Reference B | Example C Reference C | Example D Invention | Example E Invention | Example G Invention |
| 1.4 Base oils: | | | | | | |
| naphthene-based base oil | 49.60 | 34.37 | 43.17 | 41.20 | 41.50 | 40.62 |
| paraffin-based base oil | 34.85 | 44.20 | 41.37 | 41.70 | 41.38 | 42.12 |
| 1.5 additives: | | | | | | |
| Antioxidant 1 | 0.50 | 0.50 | 0.50 | 0.50 | 0.50 | 0.51 |
| Antioxidant 2 | 0.50 | 0.50 | 0.50 | 0.50 | 0.50 | 0.51 |
| EP/AW | 0.50 | 0.50 | 0.50 | 0.50 | 0.50 | 0.51 |
| Solid lubricant 1 | 0.99 | 1.00 | 1.00 | 1.00 | 1.00 | 1.02 |
| Solid lubricant 2 | 1.98 | 2.00 | 2.00 | 2.00 | 2.00 | 2.04 |

It should be understood that the inventive concepts disclosed herein are capable of many modifications. To the extent such modifications fall within the scope of the appended claims and their equivalents, they are intended to be covered by this patent.

The invention claimed is:

1. A constant velocity joint having an encapsulation in an area of a lubricating point of the joint, the encapsulation being a boot and comprising a grease composition and a thermoplastic elastomer comprising one or more ester bonds and encapsulating the lubricating point of the joint and a grease composition, the grease composition comprising:

at least one base oil;

at least one additive;

at least one thickener, wherein the thickener is a complex soap comprising a calcium/lithium soap and at least one complexing agent; and an excess of calcium hydroxide, the grease composition comprising a calcium to lithium molar ratio of greater than 1.0 to 5.0:1, the calcium to lithium molar ratio calculated based on the molar ratio of $LiOH*H_2O$ to $Ca(OH)_2$, wherein lithium hydroxide and $Ca(OH)_2$ used in the process of making the soaps are used in an amount to ensure that the lithium hydroxide is reacted as completely as possible with one or more carboxyl groups to avoid excess of lithium hydroxide and any unreacted carboxyl group are reacted with the calcium hydroxide to result in an excess of calcium hydroxide as alkaline buffer.

2. The constant velocity joint according to claim 1, wherein the grease composition comprises:

55 to 92 wt. % of the base oil;

0.5 to 40 wt. % of the additive(s);

5 to 25 wt. % of the calcium/lithium soap and 1 to 20 wt. % of the complexing agent, and excess $Ca(OH)_2$, each amount being relative to the total composition.

3. The constant velocity joint according to claim 1, wherein the grease composition has a cone penetration value of 265 to 385 mm/10 at 77° F. determined according to ISO 2137.

4. The constant velocity joint according to claim 1, wherein the base oil has a kinematic viscosity of 20 to 2500 $mm^2/s$ at 104° F.

5. The constant velocity joint according to claim 1, wherein the calcium/lithium soap is a mixture and/or conversion product of a lithium hydroxide and a calcium hydroxide of an optionally substituted saturated or unsaturated monocarboxylic acid having 10 to 32 carbon atoms.

6. The constant velocity joint according to claim 1, wherein the complexing agent is one or more members selected from the groups consisting of:

an alkali salt, an alkaline earth salt, and an aluminium salt of an optionally substituted saturated or unsaturated monocarboxylic acid having 2 to 8 carbon atoms or an optionally substituted dicarboxylic acid having 2 to 16 carbon atoms;

an alkali salt of boric acid and an alkaline earth salt of boric acid; and a phosphoric acid and a phosphoric acid ester.

7. The constant velocity joint according to claim 1, wherein the additive is one or more members selected from the groups consisting of:

antioxidants comprising amine compounds, phenol compounds, sulphur antioxidants, zinc dithiocarbamate, and zinc dithiophosphate;

high-pressure additives comprising organic chlorine compounds, sulphur, phosphorus, calcium borate, zinc dithiophosphate, and organic bismuth compounds;

C2 to C6 polyols, fatty acids, fatty acid esters, animal oils, and vegetable oils;

anticorrosives comprising petroleum sulfonate, dinonylnaphthalone sulfonate, and sorbitan ester;

metal deactivators comprising benzotriazole, and sodium nitrite;

viscosity improvers comprising polymethacrylate, polyisobutylene, oligo-dec-1-ene, and polystyrenes;

antiwear additives comprising molybdenum-di-alkyldithiocarbamates, and molybdenum sulfide-di-alkyldithiocarbamates, aromatic amines;

friction modifiers comprising oleylamides, polyether- and amide-based organic compounds, and molybdenum dithiocarbamate; and solid lubricants comprising polyamides, polyimides, PTFE, graphite, metal oxides, boron nitride, metal sulfides, and inorganic salts of alkali and alkaline earth metals.

8. The constant velocity joint according to claim 1, wherein the calcium to lithium molar ratio is from 1.2 to 3.0:1, the calcium to lithium molar ratio calculated based on the molar ratio of $LiOH*H_2O$ to $Ca(OH)_2$.

9. The constant velocity joint according to claim 1, wherein the thickener is obtainable by joint conversion of one or more calcium compounds and one or more lithium compounds with carboxylic acids and/or substituted carboxylic acids in the presence of the complexing agent, and wherein:

the one or more calcium compounds are used in molar excess, and at least one of one or more calcium compounds is $Ca(OH)_2$.

10. The constant velocity joint according to claim 1, wherein the encapsulation comprises a polyester material.

11. The constant velocity joint according to claim 1, characterized in that the encapsulation comprises or consists of a polyether ester material.

12. The constant velocity joint according to claim 2, wherein the grease composition comprises 0.01 to 2 wt. % $Ca(OH)_2$.

* * * * *